US007578718B2

(12) United States Patent
Shim et al.

(10) Patent No.: US 7,578,718 B2
(45) Date of Patent: Aug. 25, 2009

(54) METHOD OF MAKING A DISPLAY DEVICE HAVING A LIGHT-BLOCKING LAYER AND DISPLAY DEVICE HAVING THE SAME

(75) Inventors: Jae Joon Shim, Yongin-Si (KR); Yeong Seok Kim, Gunpo-Si (KR); Jae Hwan Oh, Seongnam-Si (KR)

(73) Assignee: Cheil Industries, Inc., Gyungsangbuk-go (KR)

( * ) Notice: Subject to any disclaimer, the term of this patent is extended or adjusted under 35 U.S.C. 154(b) by 248 days.

(21) Appl. No.: 11/410,675

(22) Filed: Apr. 24, 2006

(65) Prior Publication Data

US 2007/0046568 A1 Mar. 1, 2007

(30) Foreign Application Priority Data

Aug. 26, 2005 (KR) ..... 10-2005-0078814

(51) Int. Cl.
*H01J 9/00* (2006.01)

(52) U.S. Cl. ..... 445/24

(58) Field of Classification Search ..... 445/23–25; 313/582–587

See application file for complete search history.

(56) References Cited

U.S. PATENT DOCUMENTS

| | | | |
|---|---|---|---|
| 5,851,732 | A | 12/1998 | Kanda et al. |
| 6,777,872 | B2 | 8/2004 | Ohtani et al. |
| 6,800,010 | B1 | 10/2004 | Hibino et al. |
| 2004/0259452 | A1 | 12/2004 | Matsumoto et al. |
| 2005/0073255 | A1 | 4/2005 | Kim et al. |

FOREIGN PATENT DOCUMENTS

| | | | |
|---|---|---|---|
| CN | 1 197 281 | A | 10/1998 |
| CN | 1 427 483 | A | 7/2003 |
| JP | 9-55167 | | 2/1997 |
| JP | 10-255670 | | 9/1998 |
| JP | 11-179278 | A | 7/1999 |
| JP | 2000-195419 | A | 7/2000 |
| JP | 2002-25451 | | 1/2002 |
| JP | 2002-025451 | A | 1/2002 |
| JP | 2002-56774 | | 2/2002 |
| JP | 2002-056774 | A | 2/2002 |
| JP | 2005-149987 | A | 6/2005 |
| KR | 10-2003-0053031 | A | 6/2003 |
| TW | 476 094 | | 2/2002 |
| TW | 567 516 | | 12/2003 |
| WO | WO 03/040248 | A1 | 5/2003 |

*Primary Examiner*—Joseph L Williams
(74) *Attorney, Agent, or Firm*—Lee & Morse P.C.

(57) ABSTRACT

Disclosed is a non-photosensitive black electrode composition and a plasma display panel having a black electrode formed using the composition. The black electrode for the plasma display panel includes the non-photosensitive composition, thus yellowing does not occur on electrodes but conductivity to a transparent electrode layer is desirably assured even though typical conductive powder and various types of black pigments are used. It is possible to conduct patterning using a photolithography process due to the simultaneous development of black and bus electrodes, which can act as electrodes due to simultaneous sintering. Since it is non-photosensitive, it is possible to use various types of black pigments, thus the material cost is reduced.

18 Claims, 6 Drawing Sheets

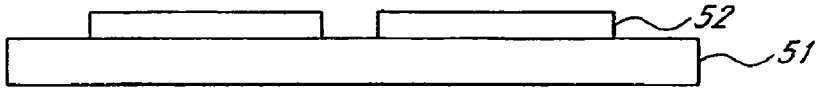
FIG. 5A
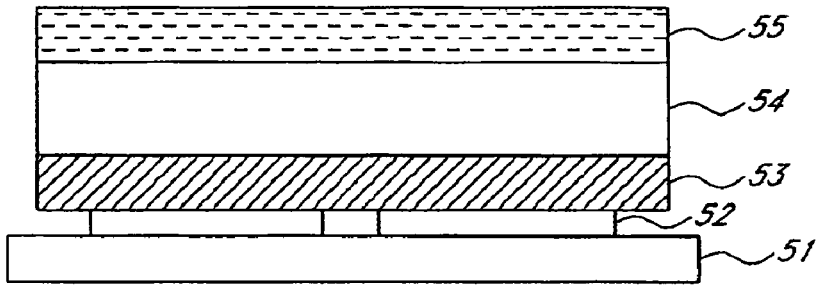
FIG. 5B
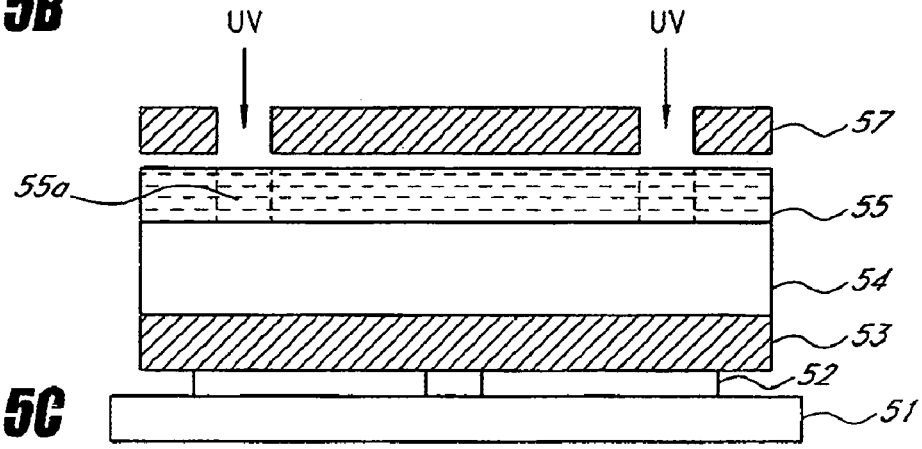
FIG. 5C
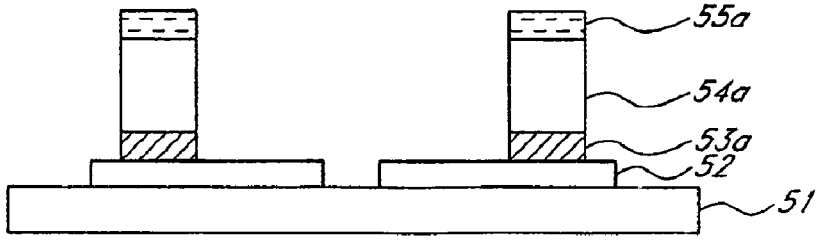
FIG. 5D
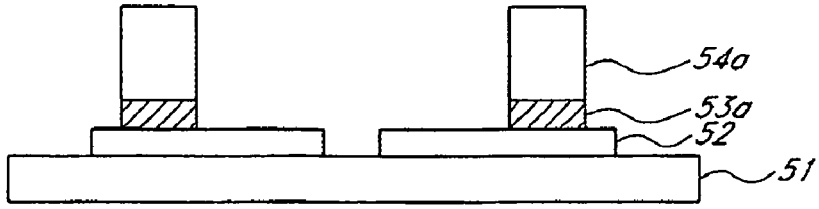
FIG. 5E
FIG. 5

METHOD OF MAKING A DISPLAY DEVICE HAVING A LIGHT-BLOCKING LAYER AND DISPLAY DEVICE HAVING THE SAME

CROSS-REFERENCE TO RELATED APPLICATIONS

This application claims the benefit of Korean Patent Application No. 10-2005-0078814, filed on Aug. 26, 2005, in the Korean Intellectual Property Office, the disclosure of which is incorporated herein in its entirety by reference.

BACKGROUND OF THE INVENTION

1. Field of the Invention

The present invention relates to display devices. More particularly, the present invention relates to a light-blocking layer which prevents ambient light from being reflected on a reflective surface of an electrode formed in the display devices.

2. Description of the Related Technology

A plasma display panel (PDP) device is one kind of flat panel display, and recently, it has competed with LCDs or projection TVs and its market has rapidly expanded.

A PDP device typically includes a front substrate with a transparent electrode (sustain electrode) and a bus electrode, and a rear substrate with a cell structure including an address electrode, a dielectric layer, a barrier rib, and a fluorescent layer.

A voltage is applied between the electrodes of both substrates to cause electric discharge in the cell and generate ultraviolet rays. The ultraviolet rays in a cell excite a fluorescent material, and thus luminescence occurs. An image which is formed by a combination of red, green, and blue (RGB) cells of a luminescent panel is displayed on the front substrate.

A bus electrode, which is typically formed of metal, on the front substrate causes ambient light to reflect back through the front substrate. This problem deteriorates image quality, including contrast. In order to improve the quality (contrast) of an image, a black electrode or layer can be used to prevent reflection by the bus electrode.

Various processes of forming a black electrode between a transparent electrode and a bus electrode have been suggested. A process of forming a black electrode layer using black metal oxide compounds and their mixture having conductivity and a black pigment consisting mostly of metal oxides having no conductivity has been used. In addition, a process of sequentially forming a black electrode layer and a bus electrode layer and sintering them on a glass substrate at high temperatures so as to reduce the visibility of the electrodes through the rear surface has been used for plasma displays. However, these approaches are costly because of the use of metal oxides, such as $RuO_2$ or ITO in the black electrode layer.

If black metal oxides are used for a photosensitive black electrode material, viscosity is significantly changed over time due to a reaction between the black pigment material and a photosensitive organic material. Thus, undesirably, only a very limited kind of metal oxides may be used as a black pigment.

Additionally, if typical silver powder is used to provide conductivity to a transparent electrode layer, certain problems such as yellowing or reduction of blackness occur.

SUMMARY OF CERTAIN INVENTIVE ASPECTS

One aspect of the invention provides a method of making a plasma display device, comprising: providing a substrate on which a visible image is to be displayed; providing a discharge sustain electrode over the substrate, the discharge sustain electrode being substantially transparent; providing a first layer for a light-blocking layer over the discharge sustain electrode, the layer being substantially free of a photosensitive material; providing a second layer for a bus electrode over the light-blocking layer; and selectively etching the second layer using photolithography so as to form the bus electrode; and selectively etching the first layer so as to form the light-blocking layer.

In the method, the first layer may comprise an organic binder in an amount from about 5 wt % to about 30 wt % and glass frit in an amount from about 30 wt % to about 50 wt % with reference to the total weight of the light-blocking layer. Selectively etching the first layer may comprise etching the first layer using the bus electrode as an etching mask. Selectively etching the first layer is carried out as selective etching of the second layer exposes a surface of the first layer and at least some of etching of the first layer may be carried out simultaneously with etching of the second layer. The second layer may comprise a photosensitive material, and selectively etching the second layer may comprise: placing a photomask over the second layer, the photomask comprising a plurality of patterned openings; projecting light onto the second layer via the plurality of openings of the photomask, whereby the photosensitive material in an exposed area of the second layer undergoes a light-activated reaction; and contacting an etchant with the second layer, whereby the etchant selectively etches the second layer leaving the bus electrode.

The method may further comprise sintering the conductive layer and the light-blocking layer. The second layer may be substantially free of a photosensitive material, and selectively etching the second layer may comprise: forming an etching mask over the second layer using photolithography; and contacting an etchant with the second layer, whereby the etchant selectively etches the second layer leaving the bus electrode under the etching mask.

In the method, forming the etching mask over the second layer may comprise: forming a photoresist layer over the second layer; placing a photomask over the photoresist layer, the photomask comprising a plurality of patterned openings; projecting light onto the photoresist layer via the plurality of openings of the photomask; and removing at least a portion of the photoresist layer to form an etching mask for selective etching of the second layer. The second layer may be substantially free of a photosensitive material. The bus electrode may be more conductive than the discharge sustain electrode. The light-blocking layer may be configured to substantially absorb ambient light incident on the substrate in a general direction toward the bus electrode.

In the method, providing the first layer and providing the second layer may comprise placing a pre-made film structure on the discharge sustain electrode, and the pre-made film structure may comprise the first layer and the second layer. The pre-made film structure may further comprise a third layer over the second layer, and the third layer may be substantially transparent to light used in the photolithography for selectively etching the second layer. The pre-made film structure may further comprise a fourth layer located between the second layer and the third layer, and the fourth layer may comprise a photoresist layer.

Another aspect of the invention provides a plasma display device made by the method described above. The device comprises the substrate, the discharge sustain electrode, the bus electrode and the light-blocking layer. The light-blocking layer is interposed and electrically connects between the discharge sustain electrode and the bus electrode. The light-blocking layer substantially absorbs ambient light incident on the substrate in a general direction toward the bus electrode. The light-blocking layer may comprise a black or substantially dark pigment, conductive particles, and glass frit.

Yet another aspect of the invention provides a composition for use in making a light-blocking layer for a display device. The composition comprises: an organic binder in an amount from about 5 wt % to about 30 wt % with reference to the total weight of the composition; glass frit in an amount from about 30 wt % to about 50 wt % with reference to the total weight of the composition; a black or substantially dark pigment; and conductive particles, wherein the composition is substantially free of a photosensitive material.

In the composition, the organic binder may be in an amount from about 15 wt % to about 30 wt % with reference to the total weight of the composition. The glass frit may be in an amount from about 35 wt % to about 50 wt % with reference to the total weight of the composition. The composition may further comprise a plasticizer in an amount from about 0.1 wt % to about 10 wt % with reference to the total weight of the composition.

BRIEF DESCRIPTION OF THE DRAWINGS

The above and other objects, features and advantages of the present invention will be more clearly understood from the following detailed description taken in conjunction with the accompanying drawings, in which:

FIGS. 5A-5E illustrate yet another embodiment of a method of forming a black electrode layer of a plasma display panel;

DETAILED DESCRIPTION OF CERTAIN INVENTIVE EMBODIMENTS

Figure 1:
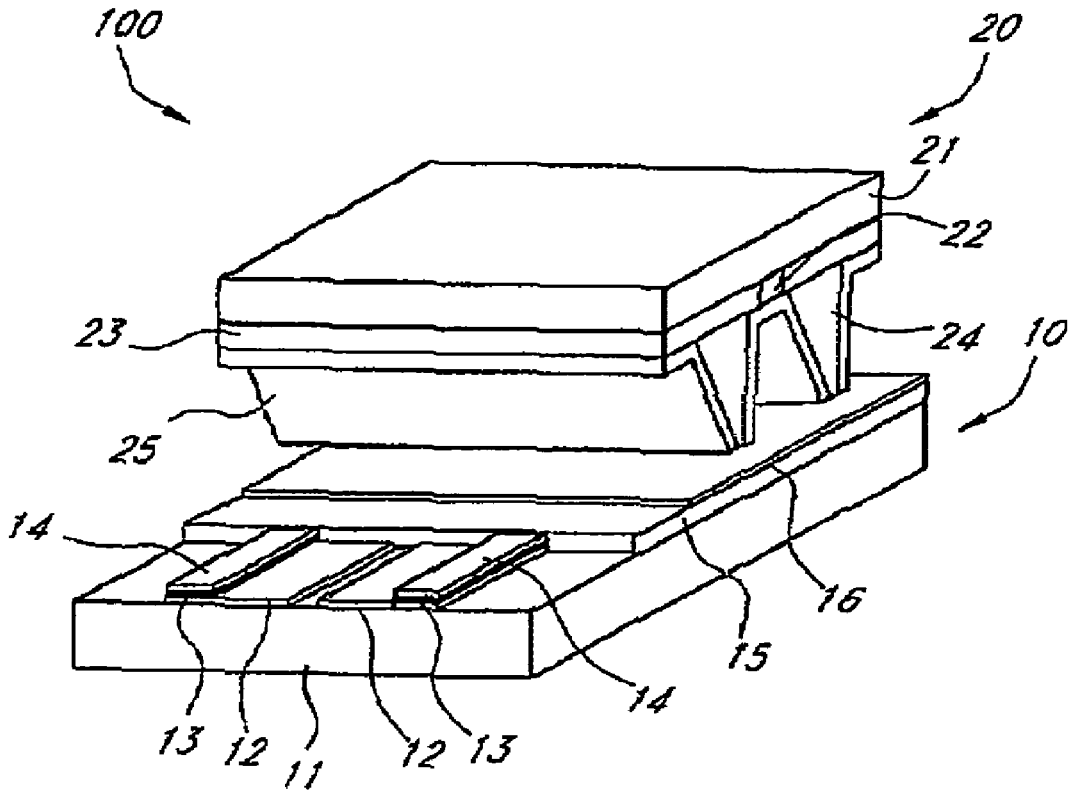
FIG. 1 Prior Art
FIG. 1 is a perspective view of a conventional plasma display panel.

A method of patterning a light-blocking layer for display devices according to embodiments of the invention will be described in detail with reference to the accompanying drawings. A light-blocking layer may also be referred to as "black layer," "black electrode layer," or "black electrode." In the drawings, like reference numerals indicate identical or functionally similar elements.

FIG. 1 illustrates a conventional plasma display panel (PDP) 100. The plasma display panel 100 includes a front panel 10 and a rear panel 20. The front panel 10 includes a front substrate 11, transparent electrodes 12, black electrode layers 13, and bus electrode layers 14, a dielectric layer 15, and a protection film 16. The real panel 20 includes a rear substrate 21, an address electrode 22, a dielectric layer 23, barrier ribs 24, and a fluorescent layer 25. A skilled artisan will appreciate that details of the plasma display panel structure may be varied depending on its design.

In the front panel 10, the transparent electrodes 12 are formed only on portions of the front substrate surface 11, as shown in FIG. 1. In addition, the black electrode layers 13 and the bus electrode layers 14 are formed only on portions of the transparent electrodes 12.

Figure 2A:
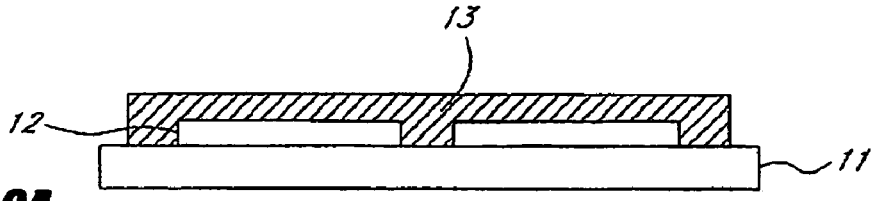
FIG. 2A Prior Art
FIGS. 2A-2E illustrate a conventional method of forming a black electrode layer of a plasma display panel.
Figure 2B:
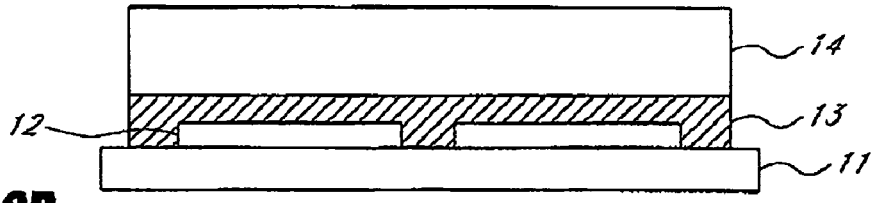
FIG. 2B Prior Art
Figure 2C:
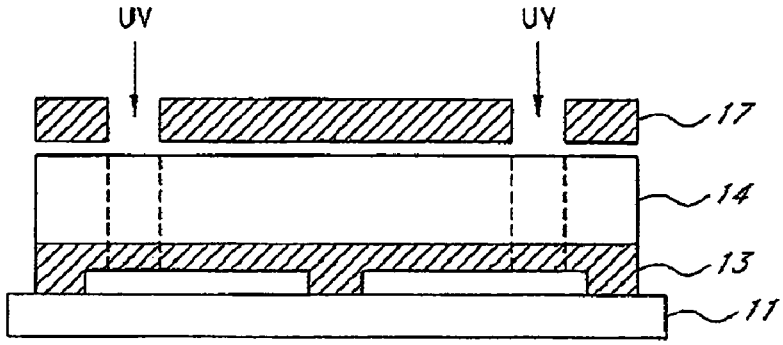
FIG. 2C Prior Art

FIGS. 2A-2E illustrate a conventional method of patterning the black electrode layers 13 and the bus electrode layers 14 on the transparent electrodes 12 of the front substrate 11. In FIG. 2A, a black layer 13 is provided over exposed surfaces of the transparent electrodes 12 and the front substrate 11. The black layer 13 typically contains a black pigment and a photosensitive material. In FIG. 2B, a bus electrode layer 14 is provided over the black layer 13. The bus electrode layer 14 typically contains a metal such as silver, and a photosensitive material.

Then, a photomask 17 is provided over the bus electrode layer 14. The photomask 17 has a pattern for exposing surfaces of the bus electrode layer 14 under which the black and bus electrodes are to be formed. In certain embodiments, the pattern may block the surfaces while opening surfaces under which no electrodes are to be formed, depending on the type of photolithography. Next, light, including, but not limited to, UV, is illuminated onto the photomask 17. At this step, the light penetrates through the black and bus electrode layers 13 and 14. The light hardens portions of the black and bus electrode layers 13 and 14 under the exposed surfaces, as shown in dotted lines in FIG. 2C.

Figure 2D:
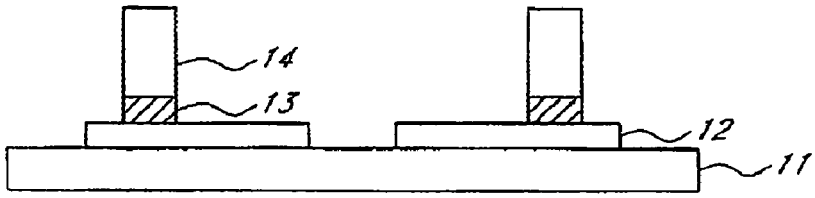
FIG. 2D Prior Art
Figure 2E:
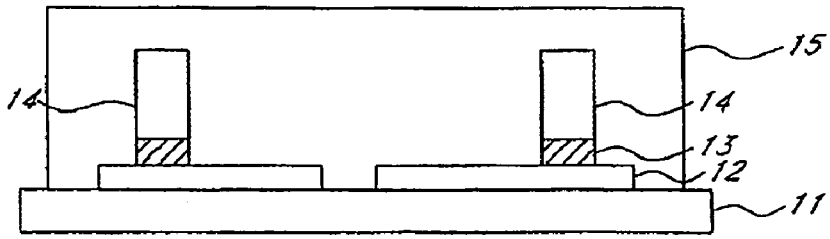
FIG. 2E Prior Art

Subsequently, as shown in FIG. 2D, the photomask 17 is removed and the layers are treated with an alkaline developing solution. The black and bus electrode layers under unexposed surfaces are removed by the solution. Then, a drying step and firing and/or sintering step are performed. Finally, a dielectric layer 15 is formed over the layers 12-14, as shown in FIG. 2E.

Method of Making a Display Device

Figure 3A:
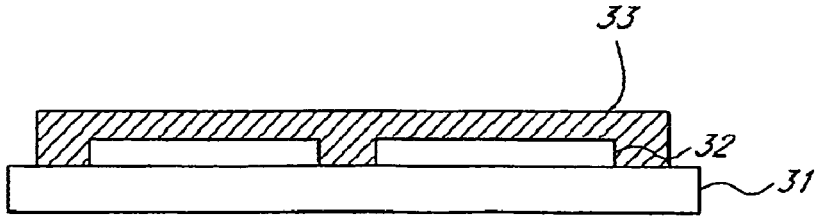
FIGS. 3A-3D illustrate an embodiment of a method of forming a black electrode layer of a plasma display panel.
Figure 3B:
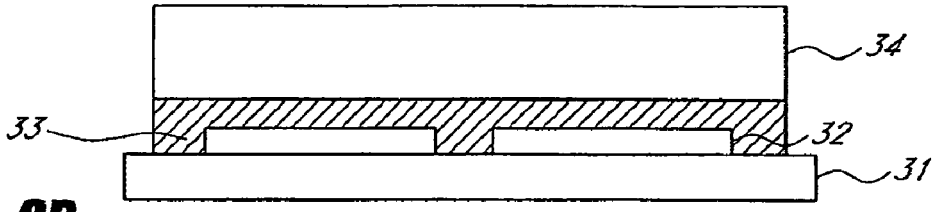
Figure 3C:
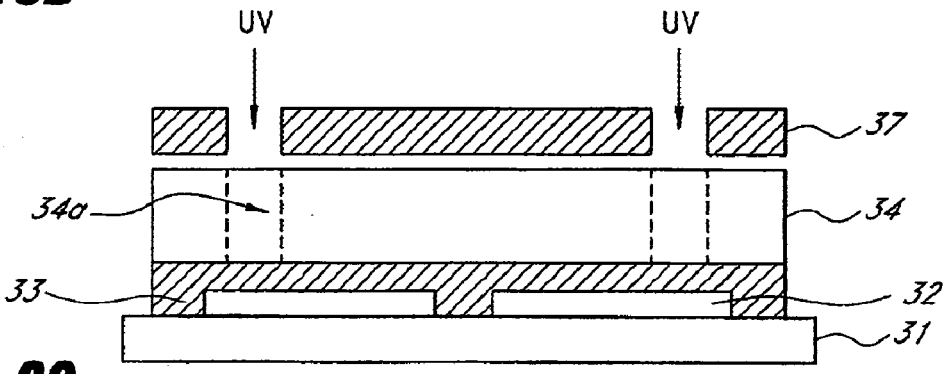

FIGS. 3A-3D illustrate an embodiment of a method of forming a light-blocking or black layer of a plasma display panel. In FIG. 3A, a black layer 33 is provided over exposed surfaces of transparent electrodes 32 and a front substrate 31. In the illustrated embodiment, the black layer 33 contains a black pigment, but is substantially free of a photosensitive material. The composition of the black layer 33 will be later described in detail. In FIG. 3B, a bus electrode layer 34 is provided over the black layer 33. In the illustrated embodiment, the bus electrode layer 34 contains a metal such as silver, and a photosensitive material. In one embodiment, the black layer 33 has a thickness between about 0.5 μm and about 3 μm. The bus electrode layer 34 may have a thickness between about 4 μm and about 8 μm.

Then, a photomask 37 is provided over the bus electrode layer 34. The photomask 37 has a pattern for exposing surfaces of the bus electrode layer 34 under which the black and bus electrodes are to be formed. Next, light, including, but not limited to, UV, is illuminated onto the photomask 37. At this step, the light only hardens portions 34*a* of the bus electrode layer 34 under the exposed surfaces, as shown in dotted lines in FIG. 3C.

Figure 3D:
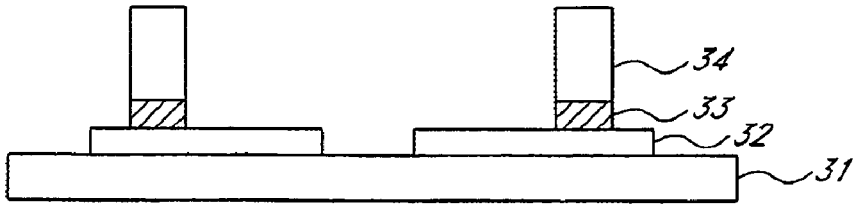

Subsequently, as shown in FIG. 3D, the photomask 37 is removed and the layers are treated with an alkaline developing solution. At this step, the bus electrode layer under unexposed surfaces is removed by the solution. The black layer under the unexposed surfaces of the bus electrode layer 34 is also removed at this step. However, the black layer 33 under the hardened portions 34*a* of the bus electrode layer 34 remains substantially intact after this step. Then, a dry step and a firing and/or sintering step are performed. Finally, although not shown, a dielectric layer is formed over the layers 32-34.

In the illustrated embodiment, even though the black layer contains no photosensitive material, the black layer 33 may be patterned simultaneously with patterning the photosensitive bus electrode layer 34 overlying the black layer 33.

Figure 4A:
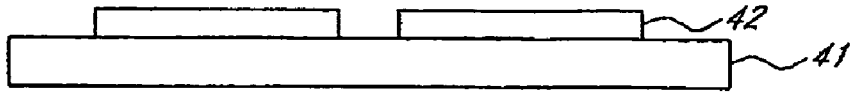
FIGS. 4A-4D illustrate another embodiment of a method of forming a black electrode layer of a plasma display panel.
Figure 4B:
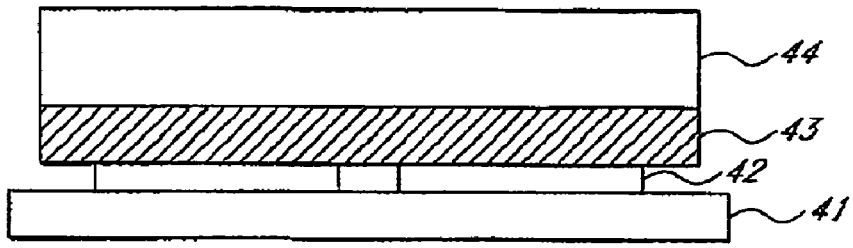
Figure 4C:
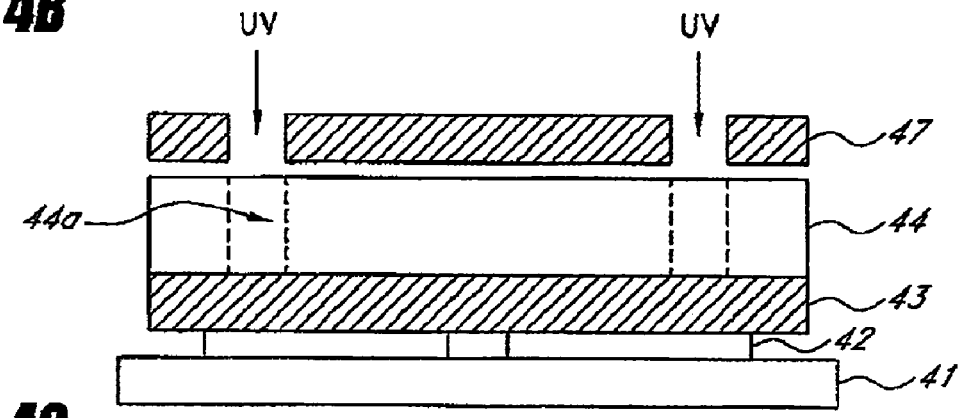
Figure 4D:
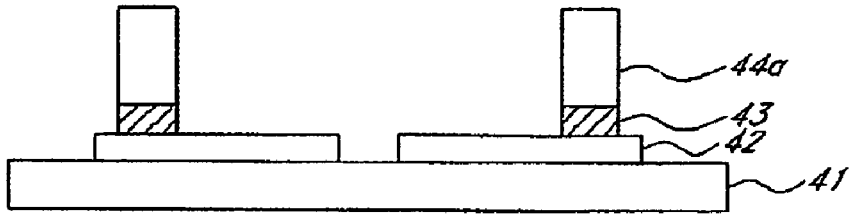

FIGS. 4A-4D illustrate another embodiment of a method of patterning a light-blocking or black layer of a plasma display panel. In FIG. 4A, transparent electrodes 42 have been formed on a front substrate 41. Next, as shown in FIG. 4B, a two-layered film including a black layer 43 and a bus electrode layer 44 is applied onto the transparent electrodes 42. Except that the layers are in a film form, the black layer 43 and the bus electrode layer 44 are as described above with respect to FIG. 3. In addition, a light-illuminating step and a layer-removing step, which are shown in FIGS. 4C and 4D, are also as described above with respect to FIGS. 3C and 3D. In certain embodiments, the film may further include a base layer such as a PET (polyethylene terephthalate) layer over the bus electrode layer 44. The base layer is removed after the light-illuminating step (FIG. 4C) and prior to the layer-removing step (FIG. 4D).

FIGS. 5A-5E illustrate yet another embodiment of a method of patterning a light-blocking or black layer of a plasma display panel. In FIG. 5A, transparent electrodes 52 have been patterned on a front substrate 51. Next, as shown in FIG. 5B, a three-layered film including a black layer 53, a bus electrode layer 54, and a photoresist layer 55 is applied onto the transparent electrodes 52. In certain embodiments, the film may further include a base layer such as a PET layer over the photoresist layer 55.

In the illustrated embodiment, the black layer 53 contains a black pigment, but is substantially free of a photosensitive material. The composition of the black layer 53 will be later described in detail. The illustrated bus electrode layer 54 contains a metal such as silver, but is substantially free of a photosensitive material. The photoresist layer 55 is formed of a material commercially available for use as a photoresist. In certain embodiments, however, the bus electrode layer 54 may contain a photosensitive material. In the illustrated embodiment, the black layer 53 has a thickness between about 10 μm and about 20 μm. The bus electrode layer 54 may have a thickness between about 10 μm and about 30 μm. The photoresist layer 55 may have a thickness between about 3 μm and about 15 μm.

Then, a photomask 57 is provided over the photoresist layer 55. The photomask 57 has a pattern for exposing surfaces of the photoresist layer 55 under which the black and bus electrodes are to be formed. Next, light, including, but not limited to, UV, is illuminated onto the photomask 57. At this step, the light penetrates through the photoresist layer 55 and hardens the portions 55*a* of the photoresist layer 55 under the exposed surfaces, as shown in dotted lines in FIG. 5C.

Subsequently, as shown in FIG. 5D, the photomask 57 is removed and the layers are treated with an alkaline developing solution. At this step, portions of the photoresist layer 55 under unexposed surfaces are removed by the solution. Portions of the bus electrode layer 54*a* and the black layer 53*a* under the unexposed surfaces of the photoresist layer 55 are also removed at this step. However, the bus electrode layer 54*a* and the black layer 53*a* under the hardened portions 55*a* of the photoresist layer remain substantially intact after this step. In the certain embodiments where the film further includes a base layer, the base layer is removed after the light-illuminating step (FIG. 5C) and prior to the layer-removing step (FIG. 5D).

Then, a dry step and a firing and/or sintering step are performed. Finally, although not shown, a dielectric layer is formed over the layers 52-54.

In other embodiments, the black layer and the bus electrode layer may be prepared in a paste form, and patterned using a screen printing process or an offset printing process. Patterning may also be conducted using a screen printing process in combination with a photolithography process.

In the illustrated embodiments, since the black layer contains no photosensitive material, yellowing due to the photosensitive material does not occur in a resulting plasma display panel. In addition, conductivity to a transparent electrode layer can be desirably assured, using silver powder and various types of black pigment. In addition, it is possible to use an inexpensive material because there is no limitation in selecting a black pigment.

Black Electrode Layer Composition

In the embodiments described above, the black electrode layer may be made from a black layer composition which includes a black pigment, conductive particles, an organic binder, and a glass frit. In one embodiment, the black layer composition includes about 10-30 wt % of the black pigment, about 1-5 wt % of the conductive particles, about 5-30 wt % of the organic binder, and about 30-50 wt % of the glass frit with reference to the total weight of the composition. In another embodiment, the composition may further include about 0.1-10 wt % of a plasticizer with reference to the total weight of the composition.

The black pigment is a material which substantially absorbs or blocks light. The black pigment has a substantially black color, including black, dark blue, etc. In one embodiment, the black color has an L* value of about 1-40. Examples of the black pigment include oxide particles, borides, nitrides, or carbides of a transition metal. In one embodiment, the black pigment does not have conductivity, and has high intrinsic electrical resistance to a conductor. In one embodiment, the particles used as the black pigment have a diameter of about 0.1-5 μm.

The conductive particles may be one or more selected from silver powder, gold powder, platinum powder, palladium powder, and alloy powder thereof. In one embodiment, the conductive particles have an average diameter of about 0.5-5 μm, optionally about 1-2 μm. In one embodiment, the conductive powder is in an amount of about 1-5 wt % with reference to the total weight of the black layer.

Examples of the organic binder include a copolymer of a carboxyl group-containing monomer and a monomer having ethylene type unsaturated double bonds. Examples of the carboxyl group-containing monomer includes an acrylic acid, a methacrylic acid, or an itaconic acid. Examples of a monomer having ethylene type unsaturated double bonds include acrylic acid ester (methyl acrylate or ethyl methacrylate), styrene, acrylic amide, or acrylonitrile, derivatives of cellulose and water-soluble cellulose, and polyvinyl alcohol. The organic binder may be used alone or in a mixture.

The organic binder may be soluble in a predetermined developing solution. If an alkaline aqueous solution (for example, 0.4% $Na_2CO_3$ aqueous solution) is used as a developing solution, a resin having a carboxyl group may be used as an organic binder. Both a carboxyl group-containing resin which has ethylene type unsaturated double bonds and a carboxyl group-containing resin which does not have ethylene type unsaturated double bonds can be used. A weight average molecular weight of the organic binder is about 1,000-200,000, optionally about 5,000-100,000. In one embodiment, an acid value of the organic binder is about 20-250 mg KOH/g.

The plasticizer is used to control solubility of the organic binder in the predetermined developing solution. Examples of the plasticizer include phthalic acid ester, adipic acid ester, phosphoric acid ester, trimellitic acid ester, citric acid ester, epoxy, polyester, and glycerol. Furthermore, a low molecular weight material (a monomer, an oligomer, and a trimer) of an acrylic compound, which is water-soluble and used as a monomer having a high boiling point, may be used as the plasticizer.

The glass frit serves as an inorganic binder. The glass frit may include lead oxides, bismuth oxides, or zinc oxides as main components. The glass frit may have a softening point of about 300-600° C. A glass transition point of the glass frit may be about 200-500° C. In one embodiment, the glass frit has a particle size of about 5 μm or less.

In addition, the black layer may further include a solvent, a dispersing agent, a viscosity stabilizing agent, an antifoaming agent, or a coupling agent to control viscosity.

Display Devices

One aspect of the invention provides a display device made by the method using the black layer composition described above. In the embodiments described above, the light-blocking and conductive layers may be sintered after electrode patterns have been formed. A resulting display device may include a substantially transparent electrode, a substantially reflective electrode, and a light-blocking layer interposed between the transparent and reflective electrodes. In one embodiment, because an organic binder in the black layer composition is removed after the sintering step, the light-blocking layer includes glass, a black pigment, and conductive particles, but is substantially free of the organic binder.

According to the embodiments, copper-iron or copper-chromium black complex oxide pigments, which are conventionally known to increase the viscosity of a composition, may be used without reducing stability of the composition, such as a change in viscosity. In addition, it is possible to use an inexpensive black pigment material.

In addition, conductivity between the transparent electrode and the upper electrode by the interposition of an insulating layer therebetween is established by mutual diffusion during a sintering process. If sintering is conducted at 540-580° C., which corresponds to a production condition of the front substrate of the PDP, it is possible to assure desirable conductivity using various types of black pigments with a small amount of conductive particles.

According to the embodiments, the image contrast is improved. In addition, conductivity to the transparent electrode is assured and the electrodes can be formed at a low cost.

A better understanding of the invention may be obtained through the following examples and comparative examples which are set forth to illustrate, but are not to be construed as the limit of the invention.

EXAMPLE 1

31.1 wt % Texanol solution containing 40 wt % methacrylic acid methyl methacrylate copolymer was mixed with 6.09 wt % TMPTA as a plasticizer, 0.84 wt % malonic acid as a viscosity stabilizing agent, 3 wt % silver powder, 16.6 wt % cobalt oxides, and 39.4 wt % glass frit, agitated, kneaded and then dispersed using a ceramic 3 roll mill to produce a black electrode composition. Texanol was further added thereto as a diluting solvent to control viscosity.

EXAMPLE 2

24.6 wt % Texanol solution containing 40 wt % methacrylic acid methyl methacrylate copolymer was mixed with 7.56 wt % titanium oxide powder, 7.29 wt % TMPTA as a plasticizer, 1.0 wt % malonic acid as a viscosity stabilizing agent, 3 wt % silver powder, 10.4 wt % cobalt oxides, and 42 wt % glass frit, agitated, kneaded and then dispersed using a ceramic 3 roll mill to produce a black electrode composition. Texanol was further added thereto as a diluting solvent to control viscosity.

EXAMPLE 3

24.6 wt % Texanol solution containing 40 wt % methacrylic acid methyl methacrylate copolymer was mixed with 7.56 wt % titanium oxide powder, 7.29 wt % TMPTA as a plasticizer, 1.0 wt % malonic acid as a viscosity stabilizing agent, 3 wt % gold powder, 10.4 wt % copper-chromium oxide black pigment, and 42 wt % glass frit, agitated, kneaded and then dispersed using a ceramic 3 roll mill to produce a black electrode composition. Texanol was further added thereto as a diluting solvent to control viscosity.

COMPARATIVE EXAMPLE 1

24.6 wt % Texanol solution containing 40 wt % methacrylic acid methyl methacrylate copolymer was mixed with 7.56 wt % titanium oxide powder, 7.29 wt % TMPTA as a plasticizer, 1.0 wt % malonic acid as a viscosity stabilizing agent, 10.4 wt % cobalt oxides, and 42 wt % glass frit, agitated, kneaded and then dispersed using a ceramic 3 roll mill to produce a black electrode composition. Texanol was further added thereto as a diluting solvent to control viscosity.

COMPARATIVE EXAMPLE 2

24.6 wt % Texanol solution containing 40 wt % methacrylic acid methyl methacrylate copolymer was mixed with 7.56 wt % titanium oxide powder, 7.29 wt % TMPTA as a plasticizer, 1.0 wt % malonic acid as a viscosity stabilizing agent, 10 wt % silver powder, 10.4 wt % copper-chromium oxide black pigment, and 42 wt % glass frit, agitated, kneaded and then dispersed using a ceramic 3 roll mill to produce a black electrode composition. Texanol was further added thereto as a diluting solvent to control viscosity.

EXAMPLE 4

Non-photosensitive black electrode compositions, which were produced using the above components, were combined with a photosensitive silver electrode composition. The photosensitive silver composition includes 65 wt % spherical silver powder having an average particle size of 1.5 μm, 3 wt % glass frit having a softening point of 400° C. and an average particle size of 1.5 μm, a methyl methacrylate copolymer as an organic binder component, a photosensitive monomer, a photopolymerization initiator, and a polymerization additive.

EXAMPLE 5

To conduct the evaluation, the compositions of examples 1 to 3 and comparative examples 1 and 2 were applied on a high-melting point glass plate on which a transparent electrode (ITO) was applied in a size of 10 cm×10 cm using a screen printing process, and then dried in an IR belt drying furnace at 90° C. for 10 min. The photosensitive silver electrode material from EXAMPLE 4 was applied thereon using the screen printing process through the same procedure, and dried. The resulting two-layered structure was exposed using a chromium photomask which was designed so as to have a line/space of 120 μm and using an exposing machine having a high pressure mercury UV lamp in an exposure amount of 400 mJ/cm2. After the exposure, development was conducted using 0.4% Na2CO3 aqueous solution at 30° C. to form a pattern. The developed structures which were produced using the compositions of examples 1 to 3 and comparative examples 1 and 2 were evaluated in view of the formation of a pattern based on 120 μm, and the results are shown in the following Table 1 and FIGS. 6 and 7.

Figure 6:
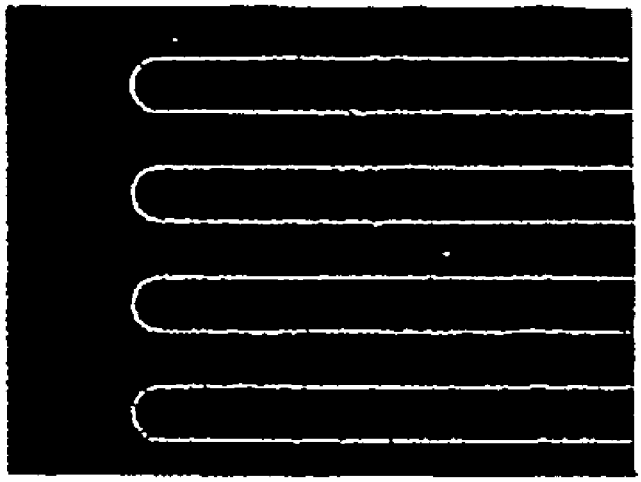
FIG. 6 is a picture showing a pattern formed according to an Example of the invention.
Figure 7:
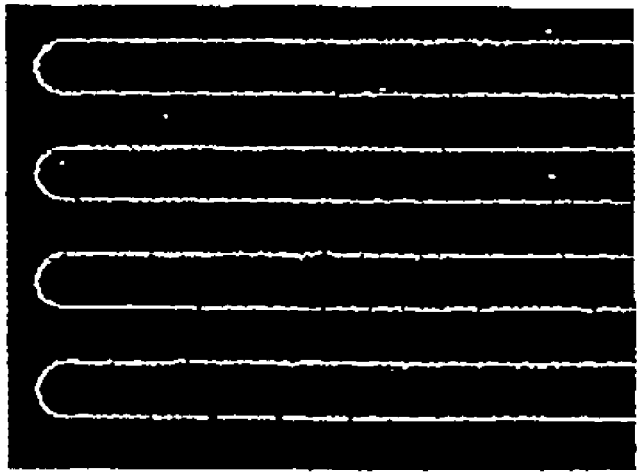
FIG. 7 is a picture showing a pattern formed according to a Comparative Example of the invention.

From Table 1, it can be seen that, even though the samples of examples 1 to 3 do not have photosensitivity, they form sharp lines as the photosensitive samples of comparative examples. FIGS. 6 and 7 are pictures showing the formation of patterns in example 2 and comparative example 1. These results show that, even though the black electrode composition of the present invention does not have photosensitivity, it is possible to form an electrode pattern using the composition after the exposure and development.

Furthermore, after the developed structures were sintered in a belt sintering furnace which was controlled so as to be maintained at 560° C. for 20 min, conductivity between the upper silver electrode and the lowermost transparent electrode layer, and blackness observed through the rear surface were measured using a colorimeter manufactured by Minolta Co., Ltd., and yellowing of the black electrode was observed with the naked eye through the rear surface. The results are described in the following Table 1. From Table 1, it can be seen that the samples of examples 1 to 3 have conductivity and blackness that are better than those of the sample of comparative example 1. Meanwhile, the sample of comparative example 2 has conductivity and blackness that are better than those of the samples of examples 1 to 3, but causes yellowing due to the high content of silver.

TABLE 1

| Item | | Ex. 1 | Ex. 2 | Ex. 3 | Co. Ex. 1 | Co. Ex. 2 |
|---|---|---|---|---|---|---|
| conductivity(ohm) | Transparent electrode-transparent electrode | 100 | 100 | 100 | 100 | 100 |
| | Transparent electrode-bus electrode | 66 | 78 | 55 | 150 | 50 |
| Blackness (L*) | | 15 | 15 | 15 | 13 | 70 |
| Formation of pattern (120 μm) | | ○ | ○ | ○ | ○ | ○ |
| Yellowing | | x | x | x | x | ○ |

The embodiments provide a non-photosensitive black electrode composition, a plasma display panel which has a black electrode including the composition, and a method of producing the panel. A front substrate of the plasma display panel formed using the non-photosensitive black electrode composition is advantageous in that conductivity between an upper electrode and a transparent electrode is assured and a desirable low visibility is attained even though costly black metal particles are not used as a conductive material. Furthermore, since it is non-photosensitive, it is possible to use various types of black pigments, thus it is possible to produce the plasma display panel at a lower cost due to the reduced material cost.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of making a plasma display device, comprising:

providing a substrate on which a visible image is to be displayed;

providing a discharge sustain electrode over the substrate, the discharge sustain electrode being substantially transparent;

providing a first layer for a light-blocking layer over the discharge sustain electrode, the layer being substantially free of a photosensitive material;

providing a second layer for a bus electrode over the light-blocking layer; and selectively etching the second layer using photolithography so as to form the bus electrode; and selectively etching the first layer so as to form the light-blocking layer.

2. The method of claim 1, wherein the first layer includes:

an organic binder in an amount from about 5 wt % to about 30 wt % with reference to the total weight of the light-blocking layer, glass frit in an amount from about 30 wt % to about 50 wt % with reference to the total weight of the light-blocking layer, a black or substantially dark pigment; and conductive particles.

3. The method of claim 1, wherein selectively etching the first layer comprises etching the first layer using the bus electrode as an etching mask.

4. The method of claim 1, wherein selectively etching the first layer includes selectively etching the second layer to expose a surface of the first layer, and wherein at least some etching of the first layer is simultaneous with etching of the second layer.

5. The method of claim 4, wherein an alkaline developing solution is used for the at least some etching of the first layer and the simultaneous etching of the second layer.

6. The method of claim 1, wherein the second layer includes a photosensitive material, and wherein selectively etching the second layer comprises:

placing a photomask over the second layer, the photomask including a plurality of patterned openings;

projecting light onto the second layer via the plurality of openings of the photomask, whereby the photosensitive material in an exposed area of the second layer undergoes a light-activated reaction; and contacting an etchant with the second layer, whereby the etchant selectively etches the second layer leaving the bus electrode.

7. The method of claim 6, wherein the etchant is an alkaline developing solution.

8. The method of claim 1, further comprising sintering the conductive layer and the light-blocking layer.

9. The method of claim 1, wherein selectively etching the second layer comprises:

forming an etching mask over the second layer using photolithography; and contacting an etchant with the second layer, whereby the etchant selectively etches the second layer leaving the bus electrode under the etching mask.

10. The method of claim 9, wherein forming the etching mask over the second layer comprises:

forming a photoresist layer over the second layer;

placing a photomask over the photoresist layer, the photomask including a plurality of patterned openings;

projecting light onto the photoresist layer via the plurality of openings of the photomask; and removing at least a portion of the photoresist layer to form the etching mask for selective etching of the second layer.

11. The method of claim 10, wherein the second layer is substantially free of a photosensitive material.

12. The method of claim 1, wherein the bus electrode is more conductive than the discharge sustain electrode.

13. The method of claim 1, wherein the light-blocking layer is configured to substantially absorb ambient light incident on the substrate in a general direction toward the bus electrode.

14. The method of claim 1, wherein providing the first layer and providing the second layer comprise placing a pre-made film structure on the discharge sustain electrode, and wherein the pre-made film structure includes the first layer and the second layer.

15. The method of claim 14, wherein the pre-made film structure further includes a third layer over the second layer, and wherein the third layer is substantially transparent to light used in the photolithography for selectively etching the second layer.

16. The method of claim 15, wherein the third layer includes a polyethylene terephthalate layer.

17. The method of claim 16, wherein the polyethylene terephthalate layer is removed after exposing the second layer to light that induces a light-activated reaction in the second layer.

18. The method of claim 15, wherein the pre-made film structure further includes a fourth layer located between the second layer and the third layer, and wherein the fourth layer includes a photoresist layer.

* * * * *